US006589604B2

(12) United States Patent
Luettenberg

(10) Patent No.: US 6,589,604 B2
(45) Date of Patent: Jul. 8, 2003

(54) PROCESS FOR APPLYING MULTI-LAYER COATINGS COMPRISING CLEAR COATS WITH ANTI-SAG UREA AND DISPERSED SILICA

(76) Inventor: Albrecht Luettenberg, Doenberger Strasse 136, Wuppertal 42111 (DE)

( * ) Notice: Subject to any disclaimer, the term of this patent is extended or adjusted under 35 U.S.C. 154(b) by 0 days.

(21) Appl. No.: 09/841,226

(22) Filed: Apr. 24, 2001

(65) Prior Publication Data

US 2003/0017274 A1 Jan. 23, 2003

(51) Int. Cl.[7] ..... B05D 1/36; B05D 1/38; B05D 3/02; B05D 7/16

(52) U.S. Cl. ..... 427/407.1; 427/409; 427/419.2

(58) Field of Search ..... 427/372.2, 402, 427/407.1, 409, 419.1, 419.2, 421; 524/492, 493, 589; 528/68

(56) References Cited

U.S. PATENT DOCUMENTS 4,311,622 A * 1/1982 Buter ..... 106/218
4,528,319 A * 7/1985 Ottaviani et al. ..... 524/500
4,677,028 A 6/1987 Heeringa et al.
4,851,294 A 7/1989 Buter et al.
5,968,655 A 10/1999 Hartung et al.
5,976,343 A 11/1999 Schlaak
6,096,378 A * 8/2000 Komatsu et al. ..... 427/407.1
6,136,303 A * 10/2000 Ruebusch et al. ..... 424/400

OTHER PUBLICATIONS

Defintion of "disperse" from Merriam–Webster's Collegiate Dictionary, 10th Edition, (c) 1998, Merriam–Webster, Inc., p. 335.*

Szycher, M., Szycher's Handbook of Polyurethanes, (c) 1999 by CRC Press LLC, pp. 4–6–4–7.*

Szycher, M., Szycher's Handbook of Polyurethanes, © 1999 by CRC Press LLC, pp. 4–6 through 4–17.*

"disperse" Merriam–Webster's Collegiate Dictionary, 10$^{th}$ ed., © 1998 by Merriam–Webster, Inc., p. 335.

* cited by examiner

*Primary Examiner*—Shrive P. Beck
*Assistant Examiner*—William Phillip Fletcher, III
(74) *Attorney, Agent, or Firm*—Sudhir G. Deshmukh

(57) ABSTRACT

A process for the production of multi-layer coatings in which a substrate is provided with a 10 $\mu$m to 25 $\mu$m thick primer surfacer substitute layer, a base coat layer determining the color shade of the multi-layer coating is applied thereto and a clear coat is applied thereto and cured, wherein a solvent-containing clear coat containing from 0.1 to 0.3 wt-% of at least one anti-sag urea compound and 0.1 to 0.4 wt-% of highly dispersed silica, in each case based on the clear coat solids, is used to produce the clear coat layer.

10 Claims, No Drawings

PROCESS FOR APPLYING MULTI-LAYER COATINGS COMPRISING CLEAR COATS WITH ANTI-SAG UREA AND DISPERSED SILICA

FIELD OF THE INVENTION

The invention relates to a process for the production of multi-layer coatings from a thin primer surfacer substitute layer, a base coat layer and a clear top coat layer.

BACKGROUND OF THE INVENTION

Modem automotive coatings comprise mostly an electrodeposition coat primer, a primer surfacer layer and a color- and/or special effect-imparting base coat/clear coat top coating.

Processes are known, for example, from WO 96/13537 and U.S. Pat. No. 5,976,343 in which the primer surfacer layer normally to be applied in a relatively high layer thickness is replaced by so-called primer surfacer substitute layers which may be applied in dry layer thicknesses of, for example, only 10 μm to 25 μm.

WO 00/71596 discloses clear coats which contain a combination of anti-sag urea compounds and silica. The urea compound content is given therein as 0.1 to 5 wt-%, preferably 0.2 to 2.5 wt-%, most preferably 0.6 to 1.8 wt-%, and the silica content is given as 0.1 to 10 wt-%, preferably 0.2 to 2.5 wt-%, most preferably 0.6 to 2.0 wt-%, in each case based on the total solids content.

There is a desire to find an improved process for the production of multi-layer coatings from a thin primer surfacer substitute layer, base coat layer and clear coat layer. It should be possible, with the process, to apply a perfectly satisfactory clear coat layer in terms of its optical surface quality from a clear coat with good sagging resistance and at the same time a low clear coat wetting limit.

Surprisingly, this can be achieved when, in such a process for the production of the clear coat layer, a clear coat is used having a very low content of at least one anti-sag urea compound and along with a very low content of highly dispersed silica.

SUMMARY OF THE INVENTION

The invention relates to a process for the production of multi-layer coatings in which a substrate is provided with a 10 μm to 25 μm thick primer surfacer substitute layer, a base coat layer determining the color shade of the multi-layer coating is applied without baking or after baking the primer surfacer substitute layer, and a clear coat layer is applied thereto and cured, wherein a solvent-containing clear coat containing from 0.1 to 0.3 wt-% of at least one anti-sag urea compound and 0.1 to 0.4 wt-% of highly dispersed silica, in each case based on the clear coat solids, is used to prepare the clear coat layer.

DETAILED DESCRIPTION OF THE EMBODIMENTS

The substrates coated with multi-layer coatings in the process according to the invention are preferably metal substrates, particularly automotive bodies or parts thereof that usually have a baked electrodeposition coat primer layer.

The primer surfacer substitute layer is applied to these substrates by spraying to form a dry layer having a thickness from 10 μm to 25 μm, preferably 15 μm to 23 μm. It may be overcoated in the unbaked state with the base coat layer but it is preferably baked initially at temperatures from, for example, 120° C. to 160° C.

In order to prepare the primer surfacer substitute layer, conventional waterborne or solvent-based coating agents may be used, for example, conventional primer surfacers known to the skilled person, or, in particular, coating agents conventionally used for this purpose and likewise known to the skilled person. Examples include the coating agents disclosed in WO 96/13537. In particular, the primer surfacer substitute layer may also be applied, for example, in the form of a first base coat layer, from a coating agent that may be produced from the actual base coat determining the color shade of the multi-layer coating, by adding suitable components, for example, a filler paste or a binder, as known, for example, from U.S. Pat. No. 5,968,655 or 5,976,343.

A base coat layer determining the color shade of the multi-layer coating is applied by spraying to the substrate provided with the baked or unbaked primer surfacer substitute layer. This base coat layer is a conventional color-and/or special effect-imparting waterborne or solvent-based base coat known to the skilled person and applied in a dry layer thickness dependent on the color shade, for example, from 8 μm to 30 μm.

The base coat layer may be baked before the subsequent application of the clear coat, but the clear coat is applied to the base coat layer preferably by the known wet-in-wet method, for example, after a brief flash-off phase for the base coat, e.g. at 20° C. to 80° C. The clear coat is applied by spraying in a dry layer thickness from, generally, 30 μm to 50 μm and optionally flashed off briefly. The substrate is then brought to the curing process, particularly a baking process in which the clear coat layer is baked together with the base coat layer at elevated temperatures, for example, from 80° C. to 160° C.

The clear coats used in the process according to the invention are liquid clear coats based on organic solvents. They contain, as constituents forming the resin solids, one or more conventional binders, optionally in addition one or more reactive thinners (compounds that are chemically incorporated in the clear coat film during curing) and, if the binders are not self-cross-linking, one or more cross-linking agents.

The clear coat cross-linking system that constitutes the resin solids may be a cross-linking system for clear coats that can be cured by free-radical polymerization and/or preferably by addition and/or condensation reactions, of the kind that may be used in the production of base coat/clear coat two-layer coatings. Thus, the clear coats may be cured by actinic radiation and/or by heating.

The clear coats are preferably externally cross-linking systems with a stoichiometric ratio adjusted to the desired degree of cross-linking of, generally, 50 to 90 wt-% binders, 0 to 20 wt-% reactive thinners and 10 to 50 wt-% cross-linking agents, the sum being 100 wt-%.

Neither the binders nor the reactive thinners are subject to any restriction, in principle. Examples of suitable film-forming binders include polyester, polyurethane and/or (meth)acrylic copolymer resins. There is no restriction on the choice of cross-linking agents, it depends on the functionality of the binders, i.e. the cross-linking agents are selected such that they have a reactive functionality that complements the functionality of the binders.

Clear coats containing cross-linking systems capable of free-radical polymerization are clear coats that cure by thermal and/or photochemical means.

Apart from thermal radical initiators and/or photoinitiators, they contain binders having olefinically unsaturated groups capable of free-radical polymerization and optionally, further components capable of free-radical copolymerization. Examples include polymers or oligomers with olefinic double bonds capable of free-radical polymerization, particularly (meth)acryloyl groups, such as, (meth)acrylic-functional (meth)acrylic copolymers, epoxy resin (meth)acrylates, polyester (meth)acrylates, polyurethane (meth)acrylates, unsaturated polyesters or unsaturated polyurethanes, for example, with number-average molecular masses in the range from 500 to 10,000.

Examples of reactive thinners include (meth)acrylic acid and esters thereof, maleic acid and half esters thereof, vinyl esters, vinyl ethers, ethylene and propylene glycol di(meth) acrylate, butane diol di(meth)acrylate, vinyl (meth)acrylate, allyl (meth)acrylate, glycerol tri-, di- and mono(meth) acrylate, trimethylol propane tri-, di- and mono(meth) acrylate, styrene, vinyltoluene, divinylbenzene, pentaerythritol tri- and tetra(meth)acrylate, di- and tripropylene glycol di(meth)acrylate, and hexane diol di(meth)acrylate.

Examples of addition reactions suitable for cross-linking clear coat cross-linking systems that can be cured by addition reactions include the addition of an epoxy group to a carboxyl group, a hydroxyl and/or an amino group to an isocyanate group, an amino group and/or CH-acidic group to an alpha,beta-unsaturated carbonyl group, particularly (meth)acryloyl group, and the addition of an amino group to an epoxy group.

Examples of condensation reactions suitable for cross-linking clear coat cross-linking systems that can be cured by condensation reactions include the reaction of an hydroxyl and/or an amino group with a blocked isocyanate group, a hydroxyl group with an N-methylol group, an hydroxyl group with an N-methylol ether group, a hydroxyl group with an ester group with transesterification, a hydroxyl group with a carbamate group with transurethanisation, and the reaction of a carbamate group with a N-methylol ether group.

The clear coats that can be cured by free-radical polymerization and/or preferably, by addition and/or condensation reactions are one- or multi-component clear coats.

The clear coats are preferably externally cross-linking one- or more preferably, two-component clear coats based on hydroxy-functional binders in each case. For example, they contain hydroxy-functional (meth)acrylic copolymers, polyester resins and/or polyurethane resins and optionally, in addition hydroxy-functional reactive thinners and at least one component cross-linking with the hydroxyl groups of the binders, such as tris(alkoxycarbonylamino)triazines, aminoplastic resins, particularly, melamine resins, and/or blocked polyisocyanates or, in the case of two-component clear coats, free polyisocyanate cross-linking agents.

The hydroxy-functional binders preferably have a number-average molecular mass from 500 to 10,000 and an hydroxyl value from 30 to 450 mg KOH/g.

Examples include conventional hydroxy-functional polyester or polyurethane resins with a number-average molecular mass from 500 to 5,000, preferably, from 1,000 to 3,000 and hydroxyl values from 30 to 450 mg KOH/g, preferably, 50 to 280 mg KOH/g and hydroxy-functional (meth)acrylic copolymer resins with a number-average molecular mass from 1,000 to 10,000 and hydroxyl values from 30 to 300 mg KOH/g, preferably, from 50 to 250 mg KOH/g. The (meth)acrylic copolymers may be produced, for example, in the presence of oligomeric or polymeric polyester and/or polyurethane resins, for example, those mentioned above.

Examples of hydroxy-functional reactive thinners include low molecular weight compounds having at least two hydroxyl groups per molecule and hydroxyl values in the range from 250 to 700 mg KOH/g. Oligomeric or polymeric polyols are suitable, such as, polyether polyols, oligoester polyols, polycarbonate polyols, polycaprolactone polyols and oligourethane polyols.

Examples of polyisocyanate cross-linking agents that may be used in the free or blocked form include (cyclo)aliphatic diisocyanates, such as, tetramethylene diisocyanate, hexane 1,6-diisocyanate, dodecane 1,12-diisocyanate, cyclohexane diisocyanate, isophorone diisocyanate, biscyclohexylmethane diisocyanate or mixtures thereof and polyisocyanates derived from such diisocyanates, for example, those containing heteroatoms in the radical which links the isocyanate groups. Examples thereof include polyisocyanates containing carbodiimide groups, allophanate groups, isocyanurate groups, uretidione groups, urethane groups and/or biuret groups.

Conventional paint polyisocyanate cross-linking agents, particularly, tris-(6-isocyanatohexyl)-biuret, isophorone diisocyanate or hexane diisocyanate isocyanurates are suitable.

Suitable blocking agents for the polyisocyanate cross-linking agents described above include the conventional, for example, CH-acidic, NH-, SH- or OH-functional blocking agents. Examples include acetyl acetone, acetoacetic acid alkyl ester, malonic acid dialkyl ester, aliphatic or cycloaliphatic alcohols, oximes, lactams, imidazoles, pyrazoles.

In the state suitable for application, the clear coats have a solids content, formed from the resin solids, the urea compounds and the highly dispersed silica and optionally, other non-volatile constituents, of 40 to 70 wt-%. They contain, as volatile constituents, organic solvents, such as, glycol ethers, such as, butyl glycol, butyl diglycol, dipropylene glycol dimethyl ether, dipropylene glycol monomethyl ether, ethylene glycol dimethyl ether; glycol ether esters, such as, ethyl glycol acetate, butyl glycol acetate, butyl diglycol acetate, methoxypropyl acetate; esters such as butyl acetate, isobutyl acetate, amyl acetate; ketones, such as, methyl ethyl ketone, methyl isobutyl ketone, diisobutyl ketone, cyclohexanone, isophorone; alcohols, such as, methanol, ethanol, propanol, butanol; aromatic hydrocarbons, such as, xylene, Solvesso® 100 (mixture of aromatic hydrocarbons with a boiling range from 155° C. to 185° C.), Solvesso® 150 (mixture of aromatic hydrocarbons with a boiling range from 182° C. to 202° C.) and aliphatic hydrocarbons.

The urea compounds contained in the clear coats are addition products of diisocyanates and/or polyisocyanates derived therefrom and mono- and/or polyamines. The addition products may be defined as low molecular weight compounds that can be defined by a molecular formula or oligomeric or polymeric addition products. Urea compounds used are preferably addition products of diisocyanates, preferably, aliphatic or cycloaliphatic diisocyanates, particularly, those having a symmetrical structure, and primary amines, preferably, primary monoamines.

They are preferably solid, particularly preferably, crystalline urea compounds having particle sizes of preferably 0.1 $\mu$m to 20 $\mu$m. The solid or crystalline urea compounds preferably have a high solidification or melting point, for example, above the baking temperature of the baking clear coats, particularly over 80° C., for example, from 80° C. to 250° C. A particularly preferred urea compound is the adduct formed from 1 mole of hexane 1,6-diisocyanate and 2 mole of benzylamine.

The urea compounds may be prepared in the usual way by addition of amines having primary and/or secondary amino groups to polyisocyanates. The preparation takes place, for example, at temperatures from 20° C. to 80° C., for example, without solvents, in bulk, preferably, in an inert solvent or, particularly preferably, in the presence of binder or cross-linking agent that is inert under the reaction conditions, for example, an inert binder or cross-linking agent solution. If the clear coat contains more than one binder or more than one cross-linking agent, the preparation may take place, for example, in one of said binders or in one of said cross-linking agents.

The addition of the urea compounds during the preparation of the clear coat takes place preferably in such a way that the urea compounds are mixed with the other clear coat constituents as a preparation, for example, as a dispersion in a solvent or, particularly preferably, as a dispersion in, e.g., a part of the liquid or dissolved binder or cross-linking agent.

Further details about the urea compounds that may be used in the clear coats, starting materials, processes and process parameters for the preparation of the urea compounds and the incorporation thereof in coating agents can be derived from U.S. Pat. Nos. 4,311,622, 4,677,028 and 4,851,294, to which express but not exclusive reference is made here.

The highly dispersed silica contained in the clear coats is silica known to the skilled person and produced synthetically, for example, pyrogenic silica or silica produced by precipitation. The highly dispersed silicas have large BET surfaces, for example, from 100 to 400, preferably 200 to 400 square meters/g. They are supplied by various producers in a wide variety of types. Pyrogenic silica is used in preference. It may be advantageous if the highly dispersed silica is rendered hydrophobic.

The highly dispersed silica is added during clear coat production preferably, as a silica paste that may be prepared by dispersing or grinding the highly dispersed silica in a constituent of the resin solids, particularly, in a part of the binder or cross-linking agent.

Moreover, the clear coats may contain conventional paint additives in amounts of, for example, up to 5 wt-%, based on the total coating agent, e.g. transparent pigments or fillers, levelling agents, dyes, light protecting agents, antioxidants, polymer microparticles, such as, microgels and/or formaldehyde-releasing substances.

The examples below serve to explain the process according to the invention and show that the process according to the invention makes it possible to produce multi-layer coatings from thin primer surfacer subsitute layer, base coat layer and clear coat layer, wherein it is possible to obtain a perfectly satisfactory clear coat layer in terms of optical surface quality and wherein the clear coat layer may be applied from a clear coat coating agent with high sag resistance and at the same time a low clear coat wetting limit.

EXAMPLES

Example 1

| A base was prepared by mixing the following components: |
|---|
| 61.6 parts of a 65 wt-% solution of a methacrylic copolymer (acid value 5 mg KOH/g, hydroxyl value 147 mg KOH/g) in a 2:1 mixture of Solvesso ® 100 and butyl acetate |
| 6.7 parts of a 65 wt-% solution of a branched polyester (acid value 41 mg KOH/g, hydroxyl value 198 mg KOH/g, number-average molecular mass 1000) in Solvesso ® 100 |
| 5.3 parts of ethoxypropyl acetate |
| 6.8 parts of Solvesso ® 150 |

-continued

| A base was prepared by mixing the following components: |
|---|
| 1.2 parts of Tinuvin ® 292 from Ciba (light protecting agent) |
| 1.2 parts of Tinuvin ® 384 from Ciba (UV-absorber) |
| 2.0 parts of butyl acetate |
| 4.3 parts of butyl diglycol acetate |
| 4.4 parts of butyl glycol acetate |
| 6.5 parts of Solvesso ® 100 |

A clear coat was prepared by mixing 100 parts of the base with 50 parts of a 68 wt-% solution of a polyisocyanate hardener mixture (isocyanurate of isophorone diisocyanate and isocyanurate of hexamethylene diisocyanate in a weight ratio of 2 1) in a 2:1 mixture of Solvesso® 100 and butyl acetate.

Example 2

580 parts of the 65 wt-% solution of the methacrylic copolymer from Example 1 were diluted with 270 parts of Solvesso® 100, then 70 parts of pyrogenic silica (BET surface 220 square meters/g) were stirred in and predispersed. After the addition of 60 parts of Solvesso® 100 and 20 parts of butanol, the mixture was ground to a silica paste in a pearl mill.

Example 3

Operations were carried out as in Example 1 except that, during the preparation of the base, instead of 61.6 parts of the solution of the methacrylic copolymer and 6.5 parts of Solvessog 100, 40.0 parts of the solution of the methacrylic copolymer from Example 1, 18.0 parts of a suspension prepared in a solution of the methacrylic copolymer from Example 1 of a diurea formed from 2 mole of benzylamine and 1 mole of hexane diisocyanate (composition 35 wt-% of a 2:1 mixture of Solvesso® 100 and butyl acetate, 3.7 wt-% of diurea, 61.3 wt-% of the methacrylic copolymer from Example 1), 2.0 parts of Maprenal® MF 590 from Solutia (melamine resin), 4.0 parts of the silica paste from Example 2 and 4.1 parts of Solvesso® 100 were used.

Examples 4 to 7

In a similar way to Example 3, but with the appropriate variation in quantity proportions of the solution of the methacrylic copolymer from Example 1 and of the diurea suspension, clear coats which were inherently the same as in Example 3 but with a different diurea content were prepared (see Table 1).

Examples 8 and 9

In a similar way to Example 1 but with a variation in the quantity proportions of the solution of the methacrylic copolymer from Example 1 and the addition of appropriate quantity proportions of the silica paste from Example 2, clear coats which were inherently the same as in Example 1 but with a different silica content in each case were prepared (See Table 1).

Example 10

Operations were carried out as in Example 3 except that 49.6 parts instead of 40.0 parts of the solution of the methacrylic copolymer from Example 1, 12.0 parts instead of 18.0 parts of the diurea suspension, no silica paste and 4.5 parts instead of 4.1 parts of Solvesso® 100 were used.

Examples 11 and 12

In a similar way to Example 10, but with the appropriate variation in quantity proportions of the solution of the methacrylic copolymer from Example 1 and of the diurea suspension, clear coats that were inherently the same as in Example 10 but with a different diurea content were prepared (See Table 1).

Examples 13 and 14

In a similar way to Example 3, but with the appropriate variation in quantity proportions of the solution of the methacrylic copolymer from Example 1, of the diurea suspension and of the silica paste, clear coats that were inherently the same as in Example 3 but with a different diurea and silica content were prepared (See Table 1).

Metal panels provided with a cataphoretic primer and a 35 μm thick hydroprimer surfacer layer applied thereto and baked were spray-coated with a black waterborne base coat in a dry layer thickness of 15 μm, flashed off for 5 minutes at 70° C. and then spray-coated with the clear coats from Examples 1 and 3 to 14 in a vertical position in a wedge shape with a layer thickness gradient from 10 μm to 70 μm dry layer thickness, and after 10 minutes flashing off at room temperature, baking was carried out for 30 minutes at 130° C. (object temperature). The appearance of the clear coat surface was satisfactory in all cases.

The coating tests were repeated in a similar manner except that the hydroprimer surfacer layer had a layer thickness of 15 μm in each case. The results obtained with clear coats 1 and 3 to 14 are summarised in Table 1. Only when clear coats 6 and 7 were used, a balanced result of low clear coat wetting limit, high clear coat sag limit and good optical appearance of the clear coat surface was obtained.

TABLE 1

| Clear coat | % diurea, based on clear coat solids | % silica, based on clear coat solids | Clear coat wetting limit (μm) | Clear coat sag limit (μm) | Appearance*) |
|---|---|---|---|---|---|
| 1 | — | — | 20 | 33 | OK |
| 3 | 0.82 | 0.34 | 26 | 43 | not OK |
| 4 | 0.54 | 0.34 | 26 | 42 | not OK |
| 5 | 0.40 | 0.34 | 18 | 40 | not OK |
| 6 (inv.) | 0.27 | 0.34 | 18 | 40 | OK |
| 7 (inv.) | 0.13 | 0.34 | 18 | 40 | OK |
| 8 | — | 0.34 | 23 | 36 | OK |
| 9 | — | 0.51 | 22 | 35 | not OK |
| 10 | 0.54 | — | 20 | 39 | not OK |
| 11 | 0.27 | — | 18 | 35 | OK |
| 12 | 0.14 | — | 18 | 34 | OK |
| 13 | 0.54 | 0.51 | 19 | 44 | not OK |
| 14 | 0.13 | 0.51 | 16 | 37 | OK |

inv. = according to the invention, *) with a 15 μm thick primer surfacer substitute layer
*Appearance "OK" means satisfactory smooth surface; "not OK" means unsatisfactory or a wavy surface, respectively.

Example 15

A clear coat was prepared by mixing the following components:

| | |
|---|---|
| 53.3 | parts of a 65 wt-% solution of a methacrylic copolymer (acid value 20 mg KOH/g, hydroxyl value 119 mg KOH/g) in a 4:1 mixture of Solvesso ® 100 and butanol |
| 28.0 | parts of Luwipa ®1 018 from BASF (melamine resin) |
| 11.8 | parts of Solvesso ® 150 |
| 0.9 | parts of Tinuvin ® 1130 from Ciba (UV absorber) |
| 0.9 | parts of Tinuvin ® 144 from Ciba (light protecting agent) |
| 0.9 | parts of Nacure ® 5225 from King (catalyst) |
| 4.2 | parts of Solvesso ® 100 |

Example 16

Operations were carried out as in Example 15 except that 41.3 parts instead of 53.3 parts of the solution of the methacrylic copolymer from Example 15 and 12.0 parts of a suspension, prepared from a solution of the methacrylic copolymer from Example 15, of a diurea formed from 2 mole of benzylamine and 1 mole of hexamethylene diisocyanate (composition 35 wt-% of a 4:1 mixture of Solvesso® 100 and butyl acetate, 3.7 wt-% of diurea, 61.3 wt-% of the methacrylic copolymer from Example 15) were used.

Example 17

Operations were carried out as in Example 16 except that 50.3 parts instead of 41.3 parts of the solution of the methacrylic copolymer from Example 15 and 3.0 parts instead of 12.0 parts of the diurea suspension from Example 16 were used.

Example 18

580 parts of the 65 wt-% solution of the methacrylic copolymer from Example 15 were diluted with 270 parts of Solvesso® 100, then 70 parts of pyrogenic silica (BET surface 220 square meters/g) were stirred in and predispersed. After the addition of 60 parts of Solvesso® 100 and 20 parts of butanol, the mixture was ground to a silica paste in a pearl mill.

Examples 19 to 22

In a similar way to Example 15 but with the appropriate variation in the quantity proportions of the solution of the methacrylic copolymer from Example 15, the silica paste from Example 18 and the diurea suspension from Example 16, clear coats were prepared which were inherently the same as in Example 15 but with a different diurea and silica content in each case (See Table 2).

Metal panels provided with a cataphoretic primer and a 35 μm thick hydroprimer surfacer layer applied thereto and baked were spray-coated with a black waterborne base coat in a dry layer thickness of 15 μm, flashed off for 5 minutes at 70° C. and then spray-coated with the clear coats from Examples 15 to 17 and 19 to 22 in a vertical position in a wedge shape with a layer thickness gradient from 10 μm to 70 μm dry layer thickness, and after 10 minutes flashing off at room temperature, baking was carried out for 30 minutes at 130° C. (object temperature). The appearance of the clear coat surface was satisfactory in all cases.

The coating tests were repeated in a similar manner except that the hydroprimer surfacer layer had a layer thickness of 15 μm in each case. The results obtained with clear coats 15 to 17 and 19 to 22 are summarised in Table 2. Only when clear coat 20 was used, a balanced result of low clear coat wetting limit, high clear coat sag limit and good optical appearance of the clear coat surface was obtained.

TABLE 2

| Clear coat | % diurea, based on clear coat solids | % silica, based on clear coat solids | Clear coat wetting limit (μm) | Clear coat sag limit (μm) | Appearance*) |
|---|---|---|---|---|---|
| 15 | — | — | 17 | 29 | OK |
| 16 | 0.44 | — | 15 | 40 | not OK |
| 17 | 0.11 | — | 14 | 30 | OK |
| 19 | — | 0.28 | 17 | 33 | OK |
| 20 (inv.) | 0.11 | 0.28 | 14 | 41 | OK |
| 21 | 0.44 | 0.52 | 18 | 45 | not OK |
| 22 | 0.11 | 0.52 | 18 | 36 | OK |

"Inv" and "Appearance" have the same meaning as in Table 1.

What is claimed is:

1. A process for the production of a multilayer coating which comprises the steps of:

(1) applying a 10 μm to 25 μm thick primer surfacer substitute layer to a substrate;

(2) applying a base coat layer to the primer surfacer substitute layer, wherein the base coat layer determines the color shade of the multilayer coating;

(3) applying a clear coat layer to the base coat layer, wherein the clear coat layer comprises (A) 0.1 to 0.3 wt-% of at least one solid anti-sag urea compound having particle sizes ranging from 0.1 μm to 20 μm, said urea compound consisting of an addition product consisting of (i) at least one polyisocyanate selected from the group consisting of diisocyanates, polyisocyanates derived from diisocyanates and combinations thereof, and (ii) at least one amine selected from the group consisting of monoamines, polyamines and combinations thereof; and (B) 0.1 to 0.4 wt.-% of dispersed silica having a BET surface area from 100 to 400 square meters/g;

wherein the antisag urea compound and dispersed silica are based on the total solids of the clear coat; and (4) curing the layers applied in steps (1) to (3).

2. A process according to claim 1, wherein the primer surfacer substitute layer, the base coat layer and the clear top coat layer are cured simultaneously by baking.

3. A process according to claim 1, wherein the primer surfacer substitute layer is baked before applying the base coat layer and then the base coat layer and the clear top coat layer are applied and cured by baking.

4. A process according to claim 1, wherein the primer surfacer substitute layer is baked before applying the base coat layer and then the base coat layer is applied and cured by baking and then the clear top coat layer is applied and cured by baking.

5. A process according to claim 1, wherein the base coat layer is applied to the unbaked primer surfacer substitute layer and the base coat layer and the primer surfacer substitute layer are cured by baking and then the clear coat is applied and cured by baking.

6. A process according to claim 1 wherein the dispersed silica is synthetic silica selected from the group consisting of pyrogenic silica and silica produced by precipitation.

7. A process according to claim 1, wherein the antisag urea compound is an addition product of a diisocyanate and a primary amine.

8. A process according to claim 1, wherein the clear coat has a cross-linking system which can be cured by reactions selected from the group consisting of free-radical polymerization, addition reactions, condensation reactions and combinations thereof.

9. A process according to claim 1, wherein the clear coat contains at least one hydroxy-functional binder and at least one cross-linking agent.

10. A process according to claim 1, wherein the multilayer coating is applied to a substrate selected from the group consisting of automotive bodies and automotive body parts.

* * * * *

UNITED STATES PATENT AND TRADEMARK OFFICE

CERTIFICATE OF CORRECTION

PATENT NO. : 6,589,604 B2
DATED : July 8, 2003
INVENTOR(S) : Albrecht Luettenberg It is certified that error appears in the above-identified patent and that said Letters Patent is hereby corrected as shown below:

Title page,
Item [73], Assignee, insert -- E.I. du Pont de Nemours and Company --

Signed and Sealed this

Twenty-eighth Day of December, 2004

JON W. DUDAS
*Director of the United States Patent and Trademark Office*